US011866896B2

(12) United States Patent
Patel

(10) Patent No.: US 11,866,896 B2
(45) Date of Patent: Jan. 9, 2024

(54) PICKUP DEVICE FOR ANIMAL WASTE

(71) Applicant: Tony Patel, Naples, FL (US)

(72) Inventor: Tony Patel, Naples, FL (US)

( * ) Notice: Subject to any disclaimer, the term of this patent is extended or adjusted under 35 U.S.C. 154(b) by 288 days.

(21) Appl. No.: 17/343,823

(22) Filed: Jun. 10, 2021

(65) Prior Publication Data

US 2022/0396923 A1 Dec. 15, 2022

(51) Int. Cl.
*E01H 1/12* (2006.01)

(52) U.S. Cl.
CPC ..... *E01H 1/1206* (2013.01)

(58) Field of Classification Search
CPC ..... E01H 1/1206
See application file for complete search history.

(56) References Cited

U.S. PATENT DOCUMENTS 5,628,537 A * 5/1997 Kiemer ..... E01H 1/1206 294/1.4
7,984,529 B2 7/2011 Manini
8,292,339 B1 * 10/2012 Auseklis ..... E01H 1/1206 294/1.4
10,273,643 B1 * 4/2019 Parazynski ..... B65F 1/062
10,633,811 B1 4/2020 Tsengas et al.
10,870,958 B2 12/2020 Fornarotto
2008/0042456 A1 * 2/2008 Patel ..... E01H 1/1206 294/1.3
2012/0256430 A1 * 10/2012 Merino-Garcia ..... E01H 1/1206 294/1.3
2017/0339921 A1 * 11/2017 Castano ..... A01K 23/005

* cited by examiner

*Primary Examiner* — Stephen A Vu
(74) *Attorney, Agent, or Firm* — Donald Debelak

(57) ABSTRACT

A device for picking up animal waste droppings or feces, the device comprises an elongated member with a handle with electronic controls on its upper connected with an elongated member to two sets of two clamps, one a set of outer clamps and one a set of inner clamps each set operated by a clamping mechanism attached to the clamp, with the two clamping mechanisms operating either simultaneously or independently, to pick up or dispose of a disposable coarse fibrous tent like material which is place over the animal waste.

10 Claims, 9 Drawing Sheets

PICKUP DEVICE FOR ANIMAL WASTE

FIELD OF THE INVENTION

The present invention relates to dog waste collection and disposal devices. More specifically, the present invention relates to an electronically operated containment system for capturing dog waste when a pet owner is outdoors with their pet.

BACKGROUND

The collection and proper disposal of pet waste is a concern for today's communities. Major metropolitan cities were the first to realize the hazards of uncollected dog waste, but today it is a concern in all communities. Some municipalities have enacted ordinances to neutralize the pet waste epidemic by requiring owners to dispose of the waste or risk a large fine.

A significant motivation behind the proper collection and disposal of pet is that it carries bacteria, parasites and viruses. Although this is more pleasant for the public, it leaves the dog owner with an extremely unpleasant task.

Another important aspect of the pet waste issue is the corresponding environmental impact that is associated with improper disposal. Pet waste that is not sanitarily collected has a high probability of ending up in storm drains that run through our cities, some of which circumvent the local treatment facility opting to feed into local bodies of water.

Many differing scooping devices have been provided to hold open a bag while the feces are scrapped or scooped therein. Various devices are known to accomplish the above mandate. It is know by pet owners to use plastic gloves that are worn on the hand which simply picks up dropping and by inverting the glove, or simple stripping the glove off the hand to invert the same, the droppings can be disposed in a sanitary manner. Others simply carry a small bucket or similar container to accomplish the task as noted above. Then there are other more complicated devices which accomplish the pickup and disposal of animal droppings in a completely sanitary manner.

DISCUSSION OF PRIOR ART PATENTS

The present invention addresses the prominent shortcomings relating to current pet waste collection and disposal devices. The majority of devices in the art contain similar methods for collecting the waste, which commonly requires a user to bend down below the waist, physically scoop up the waste in some form of a receptacle and then seal the receptacle thereby containing the waste. These devices don't work well for those who are unable to bend below the waist or who would rather deploy the device with only one hand. Other devices require only one-handed operation while not requiring people to bend over. The drawback to those devices is that they require a complete pickup of the waste in one scoop, and that their pickup device is contaminated with poop until clean. The present invention has uses a course fabric to drop over the feces which is then picked by a scooper with two sets of clamping the devices, the outer one to scoop the feces, and the second set of clamping devices to hold the coarse fabric cover until it can be disposed of.

U.S. Pat. No. 4,097,082 to Orofino describes a device which accomplishes the task of picking up animal feces. The implement described in the patent consists of an elastomeric band to automatically close the mouth of a flexible wrapper which is operated by two side plates that will swing inwardly at their bottom to grab the flexible wrapper having the animal droppings, to keep it therein and to thereafter dispose of the same, all in a sanitary manner.

U.S. Pat. No. 5,628,537 to Kiemer shows a similar device. This patent discloses a device which also uses a pair of jaws that are pivotally attached to one end of the long handle. An elongated sleeve is connected to the jays around the handle. When the jaws are locked open a bag clip engages the closed end of the ordinary thin plastic bag while the open end of the bag is inverted over the edges if the jaws. To pick up dog feces, the user positions the bag over the waste, makes the jaws to contact with the ground, rotates the sleeve to unlock a sliding motion and moves the sleeve downward on the handle. This closes the jaws and closes the waste within the bag to be disposed of at a later time in a sanitary manner.

U.S. Patent 6.305,322 to Patel (the inventor herein) discloses a waste pickup device with a cross of flexible material at one end of the handle. The cross with claws thereon will accept a sheet of paper. When the device is used to pick up animal droppings, the cross with its claws is placed over the animal waste and the cross is pulled back into a sleeve at the lower endo of the handle dropping at the lower end of the handle and as the cross collapses into the sleeve, the waste is picked up and disappears in the sleeve to be disposed of.

U.S. Patent Publication 2008/0042456 publishes an application by Patel (the inventor herein). This disclosure describes a device which comprises a handle having triggers on the upper end of the handle to operate elements at the lower end of the handle. The elements at the lower end of the handle consist of a pair of outer clam shells which are opened and closed from the triggers at the upper end. The outer clam shells have located therein a second pair of clam shells having ventral openings therein. The second pair of clamshells is always biased into an open position and operated in conjunction with the operation of the first or outer clamshells. The second pair is rotated within the first pair by an electric motor to twist a paper bag into a pile once the pet waste has been trapped within.

SUMMARY OF THE INVENTION

The present invention is a device for picking up animal waste droppings or feces. The device comprises an elongated member with a preferred handle on its upper end. The elongated member length is typically of sufficient length so that the user can manipulate the device and pickup animal waste without having to overly exert himself or herself by having to bend down and reach the ground surface. The elongated member can be formed as a tube with a hollow interior.

The invention of this application further includes two pairs of clamshell clamps at the end of the elongated member, near the ground that clamp together along a generally central point. The outer set of clamps contains a set of fasteners on the inside surface to the clamps, set in a pattern such that when the outer set of clamps close the fasteners go through holes in the inner clamps. The device works by dropping a tent shaped coarse fabric over the animal waste. The device is placed over the tent shaped coarse fabric, which preferably is longer than the length of the inside clamps, over the animal waste with the device having both clamps open, with the clamps in a general planar direction. Then both clamps are closed, the inner clamps containing the tent shaped coarse material which contains the coarse material and the animal waste.

The claws can be opened and the animal waste released when a sanitary receptacle is located.

The clamps are operated by three electrical switches on the top handle, which are connected through a printed circuit board inside the top handle to operate the clamps. The first switch opens and closes both clamps together, the second switch opens only the outer pair of claws, and the third switch opens only the inner claw. The electrical switches are operated by three batteries. The claws open and close with the use of two gears connected to clamping arms, with a motor with a turning rod for movement, such as a linear actuator, to open and close the clamps. Each of the two sets of clamps has its own set of motors and gears to open and shut. The motors and gears sit in an enclosure the sits between the elongated rod and the two sets of clamps, with the clamping arms placed within each set of clamps.

Preferably to enhance the grasping characteristic of the device, the outer clamps can be configured to include a plurality of teeth located at the lower most end (nearest to the ground) of the outer clamps, generally perpendicular to the movement of the outer clamps.

BRIEF DESCRIPTION OF THE FEATURES NUMBERS IN THE DRAWINGS

Figure 1:
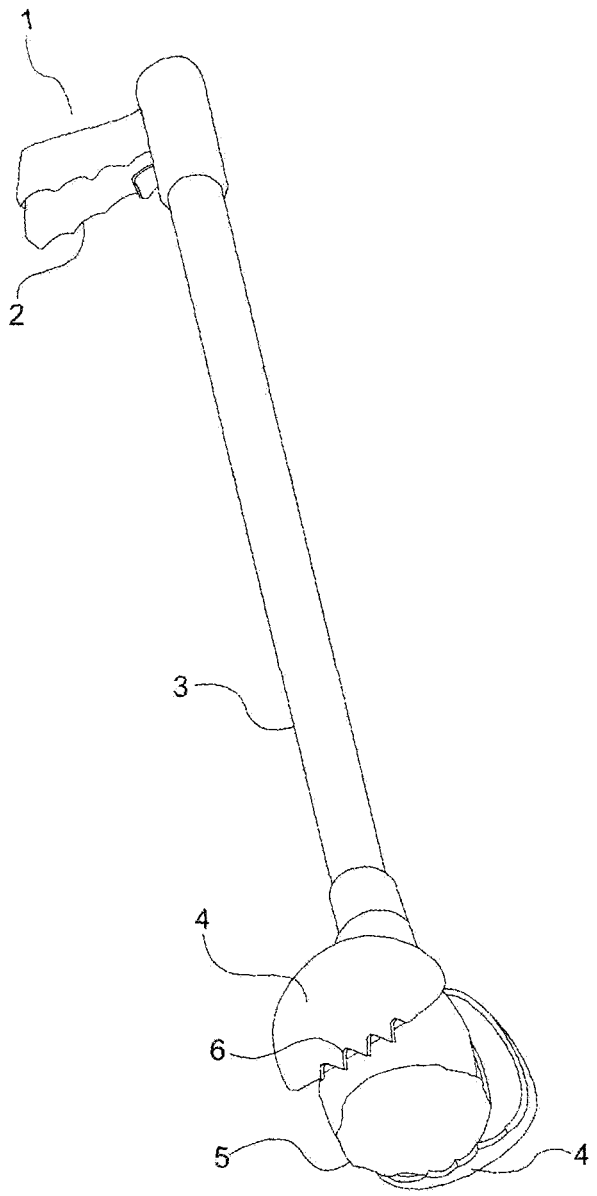
FIG. 1 is an outside look at the device, with the handle and three electric switches on the handle plus the elongated tube, and the outer and inner clamps. The housing for the motors driving the gears and the gears themselves is not shown.

1. Handle
2. Three electric switches
3. Elongated tube.
4. Outside clamps (shown in a clamshell configuration, other configurations have them in a flat configuration.)
5. Inside clamps
6. Jagged edge on outside clamps
7. Circuit board
8. Wire connection to batteries
9. Batteries
10. Wire connection between circuit board and motors operating the clamping operation.
11. Motors
12. Gears
13. Housing for motors and gears
14. Connection from elongated shaft to the housing holding the gears.
15. Arms creating the opening and closing of the clamps
16. Flat configuration clamps.
17. Fasteners protruding from outside clamps
18. Pad from which fasteners protrude.
19. Outside clamp without the fastener pad
20. Tent shaped coarse fabric
21. Turning apparatus the exits the motor and connects to the gear.

DETAILED DESCRIPTION OF THE INVENTION

FIG. 1 shows the outside of the device, with the handle 1 on top, the three electric switches 2 underneath the handle 1, the elongated tube 3, the outside clamshell clamps 4 (a second configuration uses flat clamps), the inside clamps 5 and the jagged edge on the bottom edge of the clamps 6.

Figure 2:
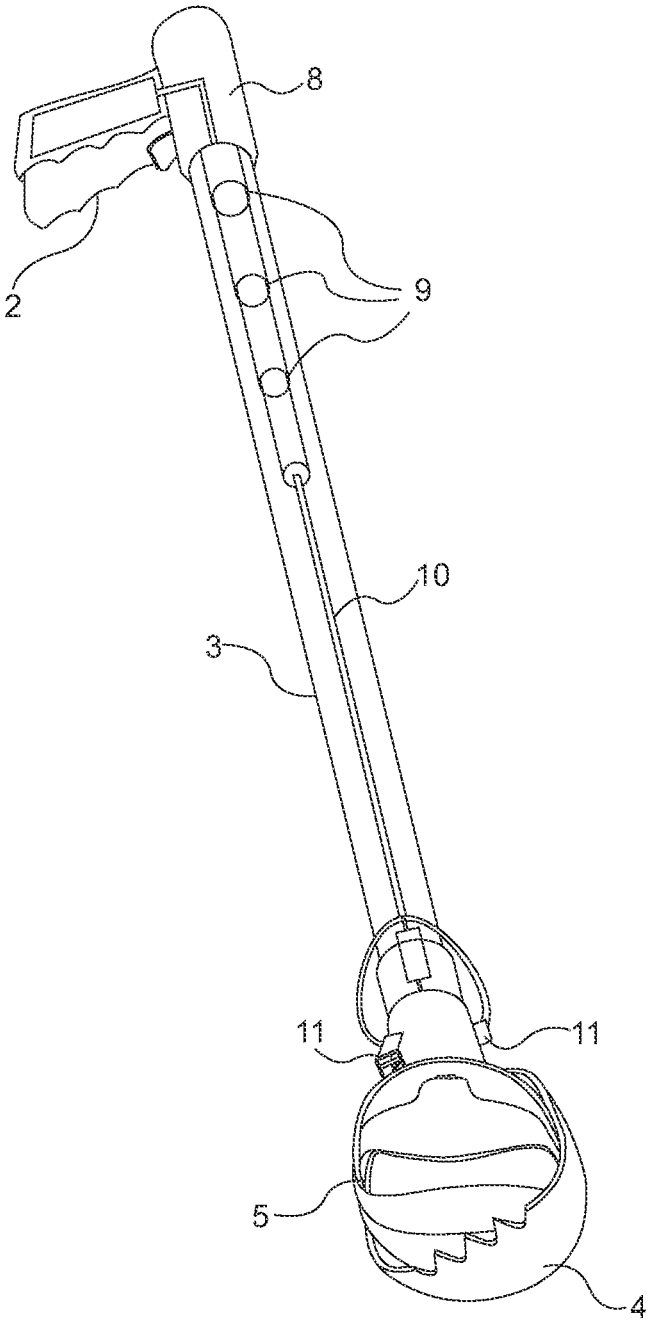
FIG. 2 show the inner components of the device, the circuit board within the handle, the battery location and the wire down to the enclosure that holds the motors and the gears.

FIG. 2 show the inside of the device, with the circuit board 7 sitting inside the handle, a wire connection 8 to the batteries 9, a wire connection between the circuit board and motors 10, the housing that hold the motors 11, the motors 12 and the housing for the motors and gears 13.

Figure 3:
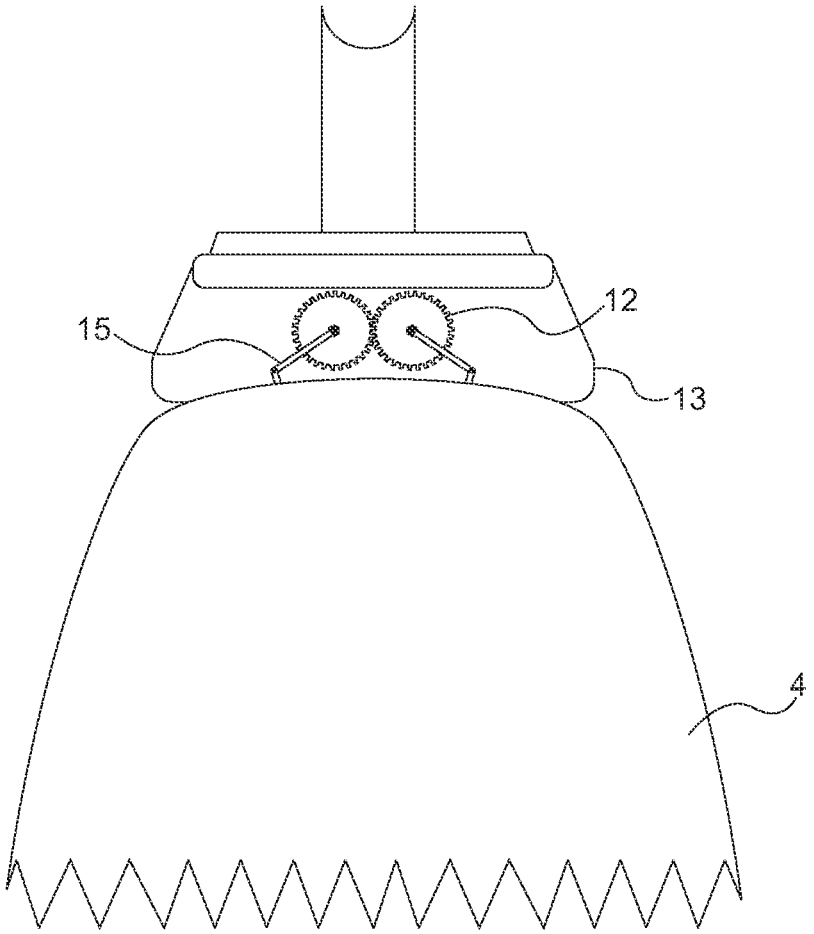
FIG. 3 shows the compartment sitting above the claws that holds the motors and the gears that operate the clamping mechanism.

FIG. 3 shows the inside of the compartment holding the motors 11 and gears 12, showing only one set of gears 13 which are connected to arms 15 (not shown) which open and close the clamps 4 and 5 (5 is not shown). The two gear sets face each other, and on the other side of each set of gears is one motor 11 with a turning apparatus 22 (not shown) that connects to the gears.

Figure 4:
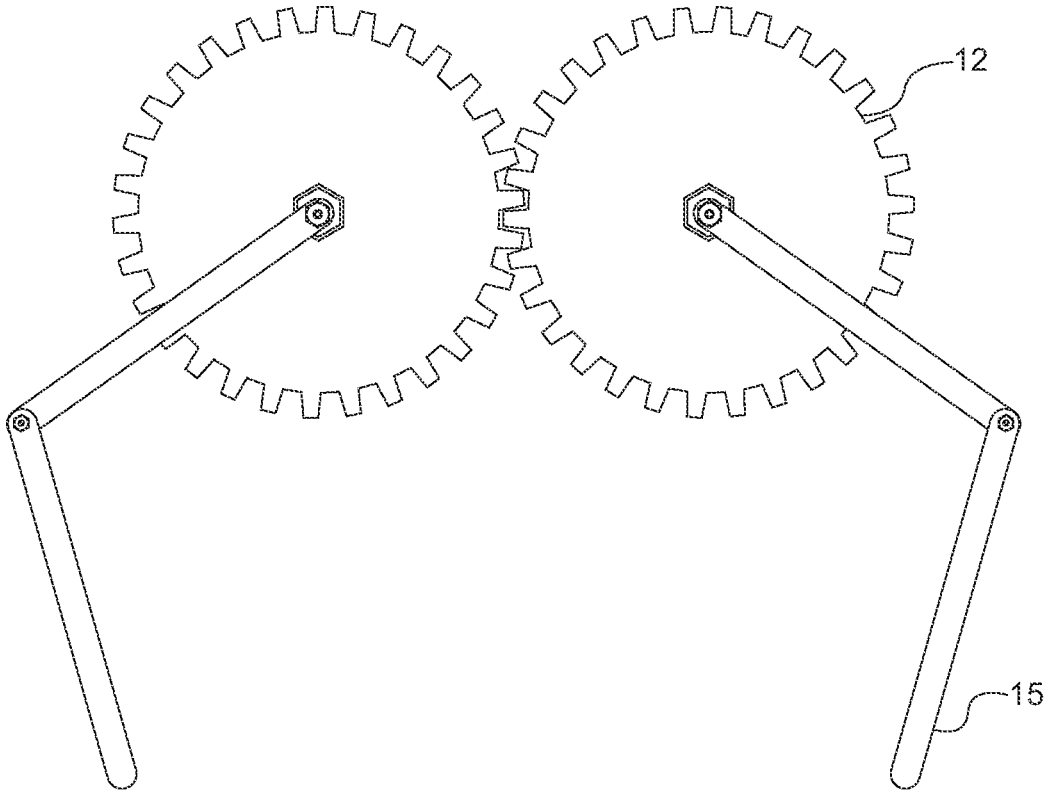
FIG. 4 shows the clamping gears and how the motor turning one gear, causes the gears to move in opposite directions opening and closing the clamps.

FIG. 4*a* and FIG. 4*b* show the gears 13 and the connected arms 15 and the movement of the arms. One motor 12 turning one way turns the other gear so that the arms open and close.

Figure 5:
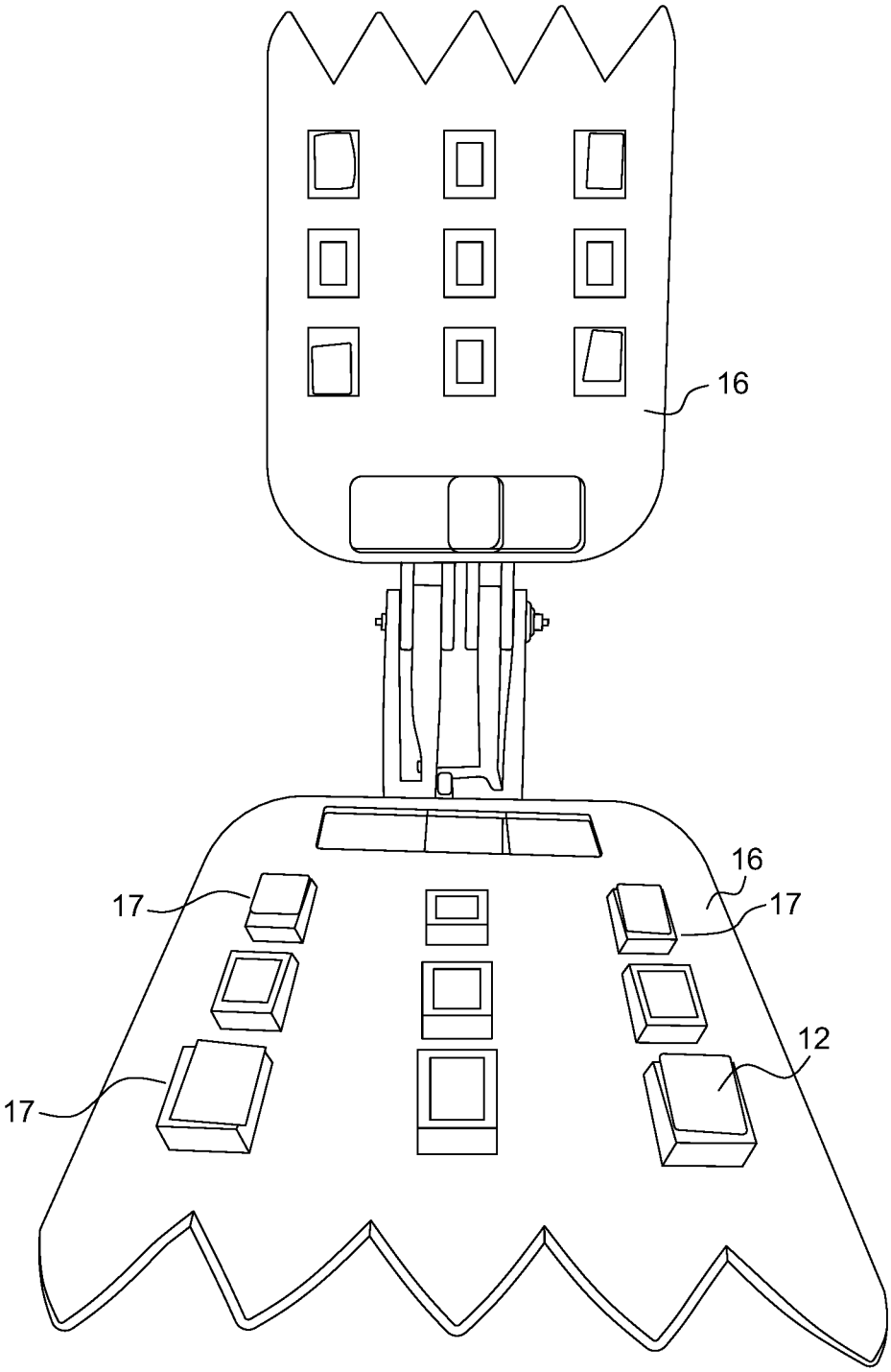
FIG. 5 shows the inside of the outside clamps with the fasteners that go through the holes in the inside clamps.

FIG. 5 shows a flat version of the outside clamps 16 with the fasteners protruding from holes in the clamp that are aligned with the holes on the inside clamps 5.

Figure 6:
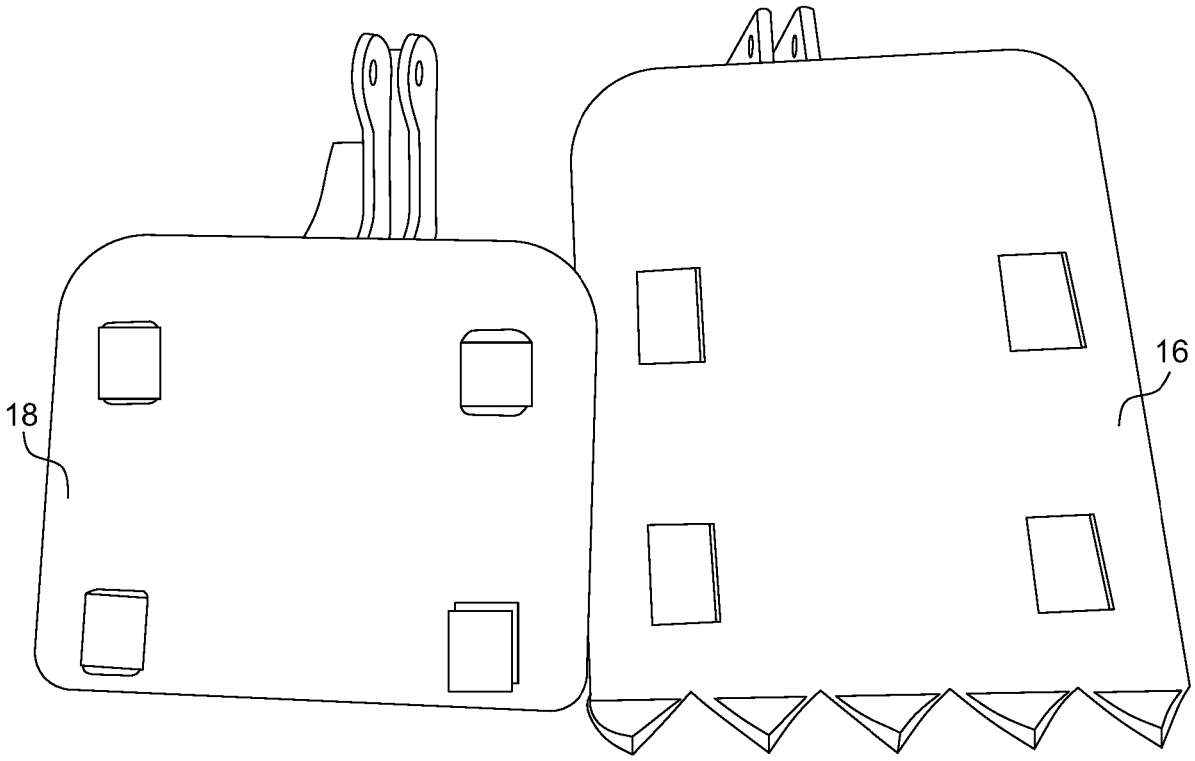
FIG. 6 shows the pad holding the fasteners that goes on the outside of the outside clamps.

FIG. 6 shows the pad 18 which is located outside the flat outside clamp from which the fasteners 17 protrude.

Figure 7:
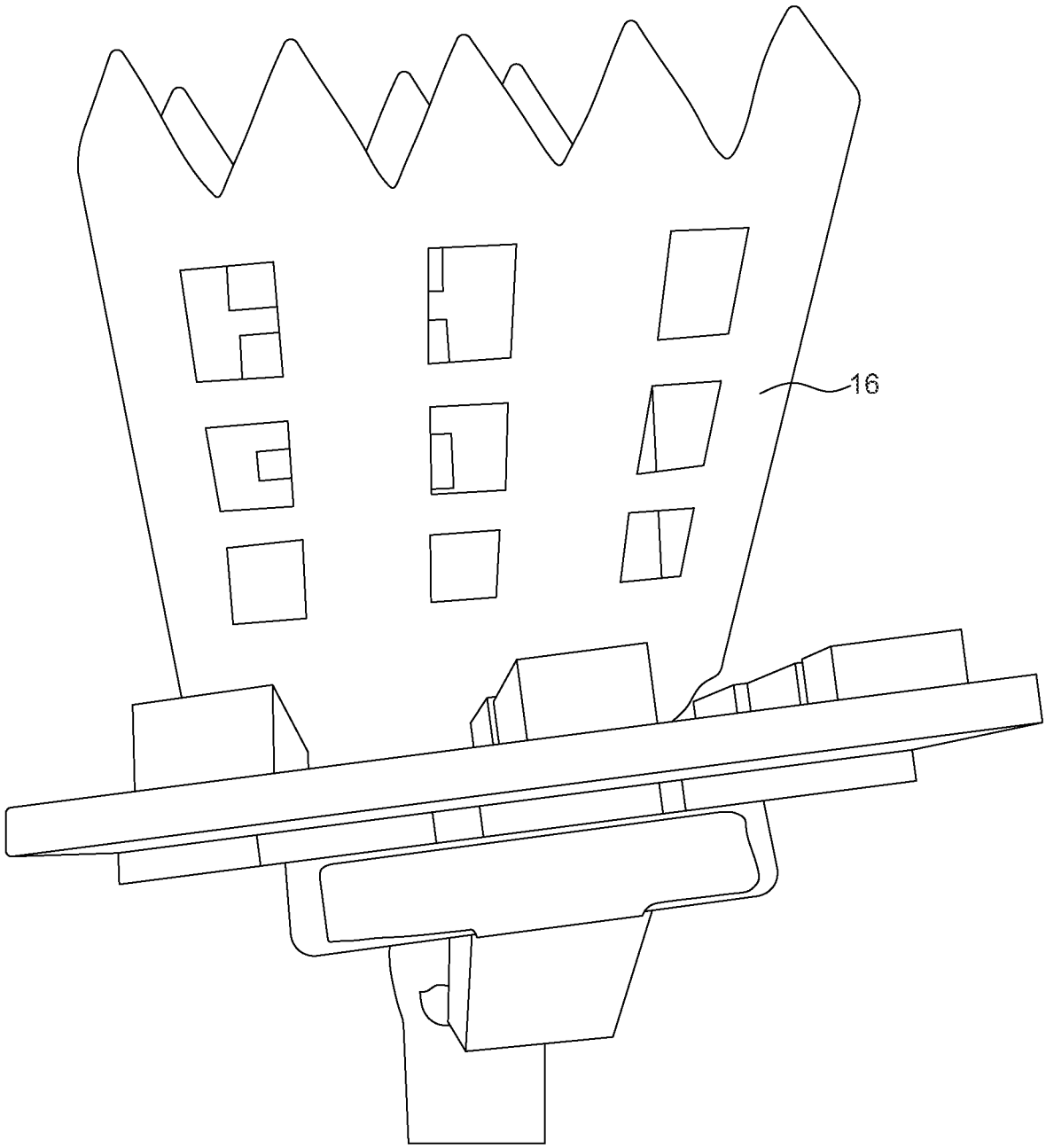
FIG. 7 shows the outside of the outside clamps without the fasteners.

FIG. 7 shows the flat outside clamps 16 closed without the pad 18 installed.

Figure 8:
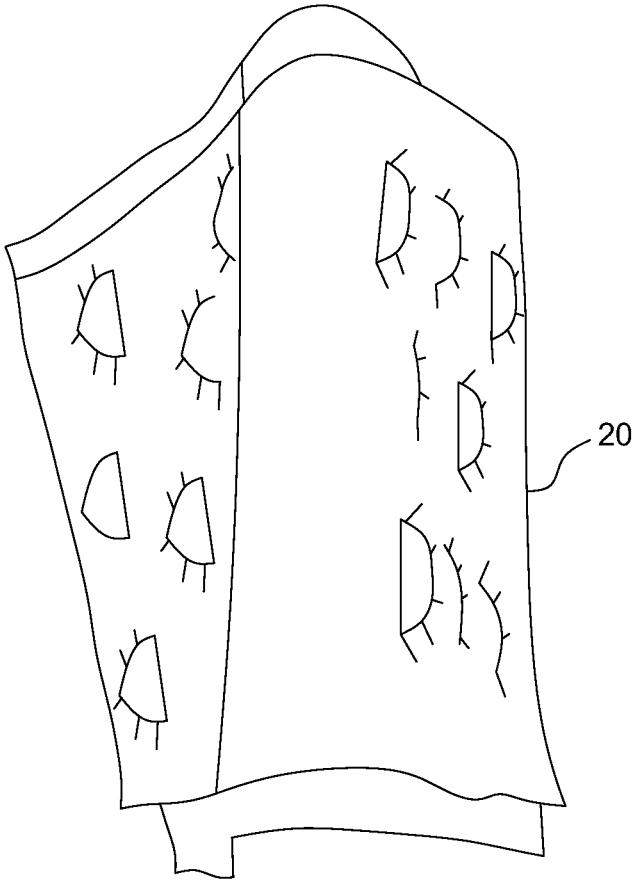
FIG. 8 shows the tented coarse fabric that is used to place over the animal waste.

FIG. 8 shows the tent shaped coarse fabric 20 as it ready to be placed over animal waste.

Figure 9:
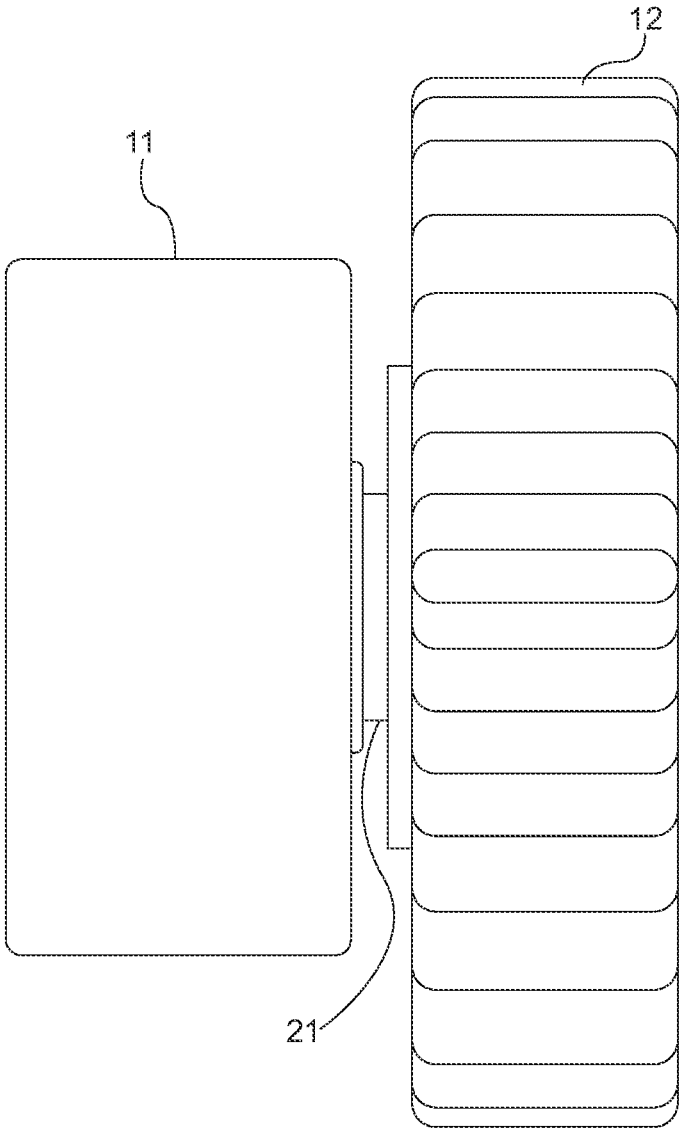
FIG. 9 shows how the electric motor's turning shaft goes into the gear that causes the clamp to open and close.

FIG. 9 shows the gear 12 and motor 11 configuration, with the turning apparatus 22 that exits the motor 11 and enters the gears 12.

It should be understood that the preceding is merely a detailed description of one or more embodiments of this invention and that numerous changes to the disclosed embodiments can be made in accordance with the disclosure herein without departing from the spirit and scope of the invention. The preceding description therefore is not meant to limit the scope of the invention. Rather the scope of the invention is to be determined only by the appended claims and their equivalents.

I claim:

1. An animal waste pickup device comprising:
an elongated tube having an upper and a lower end;
a handle on the upper end with electronic motor controls;
batteries;
an outside set of two clamps;
an inside set of two clamps that reside inside the outside set of two clamps;

the outside set of two clamps and the inside set of two clamps open and close both simultaneously and independently;

the outside set of two clamps and the inside set of two clamps opening and shutting by means of two electric motors, the first electric motor connected to a first clamping mechanism which is connected to the outside set of two clamps, a second electric motor connected to a second clamping mechanism which is attached to the inside set of two clamps;

a non-attached disposable coarse fibrous tent shaped material;

whereby, when animal waste is discovered, the non-attached disposable coarse fibrous tent shaped material is placed over the waste, the animal waste pickup device is positioned over the coarse fibrous tent shaped material, then place on the ground and one or both of the two sets of clamps are closed picking up the disposable coarse tent shaped material and the animal waste, which can then be released when appropriate by opening the sets of clamps which were closed to pick up the animal waste.

2. The animal waste pickup device of claim 1, wherein the electronic motor controls in the handle of the upper end comprise a PC board inside the handle and three motor switches on the bottom outside of the handle, the first switch to open and close both the inside and outside sets of two clamps, the second switch to open and close only the outside set of two clamps, and the third switch to open only the inside set of two clamps.

3. The animal waste pickup device of claim 1, wherein both the first and second clamping mechanisms consist of two interconnected gears, with a clamping motor mechanism attached to each gear, with each of the first and second clamping mechanisms comprising two arms set at less than a 180 degree angle that open and close each of the clamping mechanisms.

4. The animal waste pickup device of claim 3, wherein the first clamping mechanism is attached to the inside of a second clamping mechanism that is positioned next to it.

5. The animal waste pickup device of claim 4, wherein the first electric motor with a rotating shaft is attached to one of the two interconnected gears that operate to the clamping mechanism of the outside set of two clamps, of the outside set of two clamps and a second motor with a rotating shaft is attached to one gear of the two interconnected gears that operate the clamping mechanism of the inside set of two clamps.

6. The animal waste pickup device of claim 5, wherein the first and second electric motors, rotating shaft and gears sit in a separate housing sitting at an end of the elongated member above the outside and inside set of two clamps.

7. The animal waste pickup device of claim 1, wherein the clamps have a jagged edge on the outside set of two clamps.

8. The animal waste pickup device of claim 1, wherein the batteries are electrically connected to each other and are stored in the elongated tube.

9. The animal waste pickup device of claim 1, wherein the batteries are connected the PC board through a wire.

10. The animal waste pickup device of claim 1, wherein the PC board is connected to the first and second electric motors through a wire that goes through the elongated tube.

* * * * *